US008742277B2

(12) United States Patent
Tavakkoli et al.

(10) Patent No.: US 8,742,277 B2
(45) Date of Patent: Jun. 3, 2014

(54) METHOD FOR SEPARATING MINERAL IMPURITIES FROM CALCIUM CARBONATE-CONTAINING ROCKS BY X-RAY SORTING

(75) Inventors: Bahman Tavakkoli, Puch (AT); Thomas Mangelberger, Villach (AT); Matthias Reisinger, Metz (FR)

(73) Assignee: Omya International AG, Oftringen (CH)

( * ) Notice: Subject to any disclaimer, the term of this patent is extended or adjusted under 35 U.S.C. 154(b) by 407 days.

(21) Appl. No.: 12/998,856

(22) PCT Filed: Dec. 16, 2009

(86) PCT No.: PCT/EP2009/067319

§ 371 (c)(1),
(2), (4) Date: Aug. 1, 2011

(87) PCT Pub. No.: WO2010/070007

PCT Pub. Date: Jun. 24, 2010

(65) Prior Publication Data

US 2011/0288679 A1 Nov. 24, 2011

Related U.S. Application Data

(60) Provisional application No. 61/205,207, filed on Jan. 16, 2009.

(30) Foreign Application Priority Data

Dec. 19, 2008 (EP) ..... 08172445

(51) Int. Cl.
*B07C 5/346* (2006.01)

(52) U.S. Cl.
USPC ..... 209/589; 378/53

(58) Field of Classification Search
USPC ..... 209/576, 588, 589, 939; 378/45, 51, 53, 378/83, 88, 64, 68, 69; 250/370.09
See application file for complete search history.

(56) References Cited

U.S. PATENT DOCUMENTS 3,545,610 A 12/1970 Kelly et al.
4,325,514 A * 4/1982 Hemingsley ..... 241/16
5,164,590 A * 11/1992 Coles et al. ..... 250/255

(Continued)

FOREIGN PATENT DOCUMENTS

DE 41 37 008 A1 5/1993
EP 0064810 A1 11/1982

(Continued)

OTHER PUBLICATIONS

A copy of the International Search Report dated Mar. 31, 2010 for PCT Application No. PCT/EP2009/067319.

(Continued)

*Primary Examiner* — Joseph C Rodriguez
(74) *Attorney, Agent, or Firm* — Amster, Rothstein & Ebenstein LLP

(57) ABSTRACT

The present invention relates to a method for separating mineral impurities from calcium carbonate-containing rocks by comminuting the calcium carbonate-containing rocks to a particle size in the range of from 1 mm to 250 mm, separating the calcium carbonate particles by means of a dual energy X-ray transmission sorting device.

26 Claims, 6 Drawing Sheets

(56) References Cited

U.S. PATENT DOCUMENTS

| | | | | |
|---|---|---|---|---|
| 5,236,092 | A * | 8/1993 | Krotkov et al. | 209/539 |
| 5,339,962 | A | 8/1994 | Sommer, Jr. et al. | |
| 5,410,154 | A | 4/1995 | Broicher et al. | |
| 5,738,224 | A * | 4/1998 | Sommer et al. | 209/588 |
| 6,377,652 | B1 * | 4/2002 | Sturm | 378/53 |
| 6,753,957 | B1 * | 6/2004 | Graft et al. | 356/318 |
| 7,763,820 | B1 * | 7/2010 | Sommer et al. | 209/576 |
| 8,081,732 | B2 * | 12/2011 | Bruder et al. | 378/7 |
| 8,144,831 | B2 * | 3/2012 | Sommer et al. | 378/53 |
| 2010/0219109 | A1 * | 9/2010 | Roos et al. | 209/3.1 |
| 2012/0148018 | A1 * | 6/2012 | Sommer et al. | 378/53 |
| 2012/0256022 | A1 * | 10/2012 | Box et al. | 241/24.1 |
| 2013/0306765 | A1 * | 11/2013 | Tavakkoli et al. | 241/24.1 |

FOREIGN PATENT DOCUMENTS

| | | | |
|---|---|---|---|
| EP | 0 552 821 | A3 | 7/1993 |
| GB | 2285506 | A | 7/1995 |
| RU | 2131780 | C1 | 6/1999 |
| WO | 2005065848 | A1 | 7/2005 |
| WO | 2006094061 | A1 | 9/2006 |
| WO | 2008017075 | A2 | 2/2008 |

OTHER PUBLICATIONS

A copy of the Written Opinion of the International Searching Authority for PCT Application No. PCT/EP2009/067319.

* cited by examiner

METHOD FOR SEPARATING MINERAL IMPURITIES FROM CALCIUM CARBONATE-CONTAINING ROCKS BY X-RAY SORTING

This is a U.S. national phase of PCT Application No. PCT/EP2009/067319, filed Dec. 16, 2009, which claims priority to European Patent Application No. 08172445.2, filed Dec. 19, 2008 and U.S. Provisional Application No. 61/205,207, filed Jan. 16, 2009.

The present invention relates to a method for separating accompanying mineral impurities from calcium carbonate rocks of sedimentary and metamorphic origin, such as limestone, chalk and marble.

Natural carbonates have an enormous importance in the world's economy due to their numerous applications. According to their different uses, such as calcium carbonate in paper and paint industries, the final products have rigorous quality specifications which are difficult to meet.

Thus, efficient, ideally automated, techniques, are required for sorting and separating mineral impurities, which usually comprise varying amounts of dolomite and silica containing rocks or minerals such as silica in the form of flint or quartz, feldspars, amphibolites, mica schists and pegmatite, as disseminations, nodules, layers within the calcium carbonate rock, or as side rocks.

It is the objective in many fields such as in mining or waste industries to have an efficient process of automatically sorting material mixtures.

Automatic particle sorting in this respect means the separation of a bulk flow of particles based on detected particle properties that are measured by electronic sensors such as cameras, X-ray sensors and detection coils.

The suitable technique is chosen according to the particles' characteristics. Thus, there are a number of different sorting techniques, which however mostly have a very limited applicability depending on the specific particle properties. For example, optical sorting requires a sufficient colour contrast of the particles, density separation is only possible at a sufficient difference in the specific density of the particles, and selective mining is mostly inefficient as to time and costs. Where the particles to be sorted have no reliable characteristics allowing for automation, manual sorting has to be applied.

Especially, in the field of mining, the availability of high throughput automatic sorters for coarse and lump sized materials improves the overall efficiency of both mining and milling.

By using automatic rock sorting for pre-concentration, it is possible to mine heterogeneous ore deposits of a lower average grade, but with local sections, bands or veins of high grade. By pre-sorting the ore pieces before grinding, overall milling costs may decrease considerably.

Optical sorters used for minerals processing applications rely on the use of one or more colour line scan cameras and illumination from specially designed light sources. By the camera, a number of distinctive properties can be detected including shape, area, intensity, colour, homogeneity, etc. Typical applications relate to various base metal and precious metal ores, industrial minerals such as limestone and gem stones.

Optical sorters are frequently used for sorting calcium carbonate rocks. However, as mentioned, as soon as the colour contrast is not high enough, separation becomes difficult. For example, flint can be grey, brown or black, but in some quarries also as white as the chalk itself such that an optical sorter cannot remove it from the chalk. Furthermore, even in the case that there is a sufficient colour contrast, the surface of the rocks often has to be wetted and cleaned to enhance the colour contrast and colour stability. In the case of, e.g., chalk however, which is very soft and porous, washing or even wetting is not possible.

Therefore, there is the need to provide sorting techniques other than the usual ones, mainly based on colour contrast, for separating said mineral impurities from calcium carbonate-containing rocks.

X-ray sorters are insensitive for dust, moisture and surface contamination and sorting occurs directly based on the difference of the average atomic number of the rock fragments. Even if there are no visible, electric or magnetic differences, many materials can still be concentrated with X-ray sorting.

X-ray sorters however, up to now, were used especially for sorting scrap metals, building waste, plastics, coals, and metalliferous rocks and minerals, but not for removing said mineral impurities from calcium carbonate rock mainly due to the low differences in mean atomic density between said impurities and calcium carbonate.

For example, WO 2005/065848 A1 relates to a device and method for separating or sorting bulk materials with the aid of a blow-out device provided with blow-out nozzles located on a fall section downstream of a conveyor belt and an X-ray source, computer-controlled evaluating means, and at least one sensor means. The bulk materials mentioned in WO 2005/065848 A1 are ores to be separated, and waste particles, such as glass ceramic from bottle glass, or, generally, different glass types.

GB 2,285,506 also describes a method and apparatus for the classification of matter, based on X-ray radiation. In the method, the particles are irradiated with electromagnetic radiation, typically X-radiation, at respective first and second energy levels. First and second values are derived which are representative of the attenuation of the radiation by each particle. A third value is then derived as the difference between or ratio of the first and second values, and the particles are classified according to whether the third value is indicative of the presence of the particles of a particular substance. In one application of the method, it is used to classify diamondiferous kimberlite into a fraction consisting of kimberlite particles containing diamond inclusions and a fraction consisting of barren kimberlite particles.

U.S. Pat. Nos. 5,339,962 and 5,738,224 describe a method of separating materials having different electromagnetic radiation absorption and penetration characteristics. The materials separated by this method are plastic materials being separated from glass materials, metals from non-metals, different plastics from each other. The disclosed method is especially effective at separating items of differing chemical composition such as mixtures containing metals, plastics, textiles, paper, and/or other such waste materials occurring in the municipal solid waste recycling industry and in the secondary materials recycling industries.

WO 2006/094061 A1 and WO 2008/017075 A2 relate to sorting devices including optical sorters, and sorters having an X-ray tube, a dual energy detector array, a microprocessor, and an air ejector array. The device senses the presence of samples in the X-ray sensing region and initiates identifying and sorting the samples. After identifying and classifying the category of a sample, at a specific time, the device activates an array of air ejectors located at specific positions in order to place the sample in the proper collection bin. The materials to be sorted by this device are metals such as lighter weight metals like aluminium and its alloys from heavier weight metals like iron, copper, and zinc and their alloys.

EP 0 064 810 A1 describes an ore sorting apparatus in which the ore to be sorted is selected for sorting according to their absorption of atomic radiation. Ore particles are passed beneath an X-ray tube while being supported on a conveyor belt. X-rays passing through the ore particles impinge on a fluorescent screen. Images formed on the screen are scanned by a scan camera to provide sorting control signals depending on the amount of radiation absorbed by the ore particles. The ores especially examined are tungsten ores, which in particular have proven difficult to be separated using the known detection techniques, but are particularly susceptible to sorting by measurement of X-ray absorptivity under special circumstances.

RU 2 131 780 relates to the beneficiation and sorting of manganese ore including crushing the ore, separating it into fractions according to size, magnetic separation of the fine fraction, and X-ray/radiometric separation of the coarse fraction. Ore with a manganese content of less than 2% goes to dump and ore having more than 2% of manganese is subjected to X-ray/luminescent separation, providing a simplified technological process of winning manganese concentrates from ore.

Thus, there are a number of possibilities how to separate one material from another. However, up to now no efficient technique for sorting and separating mineral impurities from calcium carbonate in calcium carbonate-containing rocks, has been found due to the fact that the present techniques require sufficiently different characteristics such as density and colour of the materials to be sorted, which is problematic regarding many impurities contained in calcium carbonate-containing rocks.

Consequently, there is still a need for alternative techniques for sorting and separating said undesired mineral impurities, also comprising hard, abrasive and/or colouring minerals or rocks, even if there is no distinct colour contrast between the calcium carbonate and said impurities, from the remainder components of the rock.

The object of the present invention therefore is to provide an alternative method for efficiently separating and removing undesired accompanying mineral impurities from calcium carbonate in calcium carbonate-containing rocks of sedimentary and metamorphic origin, such as limestone, chalk and marble, especially, if the colour contrast in the rocks is low or the surface nature of the particles does not allow conditioning required to create or enhance colour contrast (i.e. washing, wetting).

The object of the invention is achieved by a method as defined in the independent claims. Advantageous embodiments of the present invention are derived from the subclaims and the following description.

It was surprisingly found that devices using the dual energy X-ray transmission technology can be advantageously used for separating and removing undesired mineral impurities from calcium carbonate in calcium carbonate-containing rocks.

This finding is surprising as usually the X-ray technology requires a certain difference in the density of the materials to be separated, which is not the case regarding materials such as, e.g. calcium carbonate and dolomite or flint, which could not be expected to be separable by X-ray sorting.

This is the reason why X-ray sorting up to now has been mainly used for separating materials being sufficiently different in density such as light and heavy metals, e.g. aluminium and magnesium from a fraction rich in heavy metals such as copper, bronze, zinc and lead, or plastic materials from glass materials, metals from non-metals, or different plastics, from each other.

The X-rays emitted from the X-ray source penetrate the raw material and get absorbed according to the average atomic mass and the particle size of the scanned material. X-ray detectors installed opposite the X-ray source detect the transmitted X-rays and convert them into an electrical signal according to the X-ray intensity. In order to eliminate the influence of the particle size of the material scanned, the dual energy technology uses a single X-ray source and two X-ray detectors to scan the rocks. One X-ray detector measures the unfiltered X-ray intensity; the second detector is covered with a metal filter and thus measures a reduced X-ray intensity. By forming the quotient of the measured unfiltered and filtered X-ray intensities the influence of the particle size can be eliminated. The calculated X-ray signal can be correlated to the average atomic mass of the scanned material and thus different raw materials can be detected and sorted according to their average atomic mass.

As the X-radiation penetrates through the rock also associated particles can be detected and sorted efficiently.

Accordingly, the object of the present invention is achieved by a method for separating accompanying mineral impurities from calcium carbonate-containing rocks by comminuting and classifying the calcium carbonate rocks to a particle size in the range of from 1 mm to 250 mm, separating the calcium carbonate particles by removing the particles comprising components other than calcium carbonate by means downstream of a detection area and controllable by computer-controlled evaluating means as a function of sensor signals resulting from radiation penetrating a flow of said particles, said radiation being emitted by an X-ray source and captured in at least one sensor means, wherein the X-radiation is permitted to pass at least two filter devices in relation to mutually different energy spectra positioned upstream of the at least one sensor means and sensor lines with sensor means, a sensor line being provided for each of the at least two filters.

The separation step is advantageously carried out in a device according to WO 2005/065848, the disclosure of which herewith is explicitly included.

The device and method described therein especially was developed for providing a safe arrangement with which it is not only reliably possible to detect small metal parts such as screws and nuts, but permitting the reliable separation thereof from the remaining bulk material flow through blow-out nozzles directly following the observation location. There is however no indication that the device and method could also be used with a mineral containing material like calcium carbonate-containing rocks.

As mentioned above the device is characterized by the use of two X-ray filters for different energy levels which are, in each case, brought in front of the sensors, such that different information concerning the particles can be obtained. Alternatively, the filters can directly follow the X-ray source, or use can be made of X-ray sources with different emitted energies.

Preferably, the means for separating the calcium carbonate particles are blow-out nozzles blowing out the particles other than calcium carbonate.

If the particles are crowded, it may be useful to use a fall section, wherein the separating means are located on this fall section downstream of the detection area.

Through a suitable filtering of the X-radiation upstream of the particular sensor of the two-channel system, there is firstly a spectral selectivity. The arrangement of the sensor lines then permits an independent filtering so that the optimum selectivity for a given separating function can be achieved.

Each of the sensor lines comprises a plurality of detector means. Suitable detector means for the use in the present invention are for example photodiode arrays equipped with a scintillator for converting X-radiation into visible light.

A typical array has 64 pixels (in one row) with either 0.4 or 0.8 mm pixel raster. The line first cut from the sorting product, as a result of the material flow direction, is delayed until the data are quasi-simultaneously available with those of the subsequently cut line (with the other energy spectrum). The thus time-correlated data are converted and transmitted to the evaluation electronics.

Because sorting according to the present invention is a single particle method, each of the particles has to be presented separately and with sufficient distance to other particles. To achieve this individualization of the particles, two basic types of sorters may be used:

a) the "belt-type" sorter, where the feed is presented on a belt with a typical velocity of 2-5 m/s (according to WO 2005/065848), or
b) the "chute-type (or gravity)" sorter, where the particles are individualized and accelerated while sliding down a chute. The detection takes place either on the chute or on the belt.

Although the chute-type version is usually preferred, both types are basically applicable for the successful separation of impurities from calcium carbonate-containing rocks using X-ray sorting according to the present invention.

Preferably, a sensor line corresponding to the particle flow width is formed by lined up detector means, such as photodiode arrays, whose active surface may be covered with a fluorescent paper or other suitable screens.

The filters are preferably metal foils through which X-radiation of different energy levels is transmitted. However, the filters can also be formed by crystals, which reflect X-radiation to mutually differing energy levels, particularly X-radiation in different energy ranges in different solid angles.

Generally, a higher energy spectrum and a lower energy spectrum are covered. For the higher energy spectrum, a high pass filter is used which greatly attenuates the lower frequencies with lower energy content. The high frequencies are transmitted with limited attenuation. For this purpose, it is possible to use a metal foil of a metal with a higher density class, such as a 0.45 mm thick copper foil. For the lower energy spectrum, the filter is used upstream of the given sensor as an absorption filter which suppresses a specific higher energy wavelength range. It is designed in such a way that the absorption is in close proximity to the higher density elements. For this purpose, it is possible to use a metal foil of a lower density class metal, such as a 0.45 mm thick aluminium foil.

The spatial arrangement of the filters can be fixed so that by moving the particles, it is possible to bring about a suitable filter-following reflection of the x-radiation, e.g., by crystals onto a detector line or row, in the case of an association of two measured results recorded at different times for the particles advancing on the bulk material flow.

Preferably the at least two filters are positioned below the particle flow and upstream of the sensors, and an X-ray tube producing a bremsstrahlung spectrum is positioned above the particle flow.

Through the upstream placing of filters, it is possible to restrict the X-radiation to a specific energy level with respect to an X-ray source emitting in a broader spectrum prior to the same striking the particles. No further filter is then required between the bulk material particles and a downstream sensor.

In another variant of the device, it is also possible to work with two sensors, which follow one another transversely to the particle flow and are, e.g., located below the same. Through suitable mathematical delay loops, it is then possible to associate the successively obtained image information with individual bulk material particles and, following mathematical evaluation, use the same for controlling the blow-out nozzles.

It is preferred that the at least two filters include a plurality of filters for using with a plurality of energy levels.

Filtering of the X-radiation, which has traversed bulk material particles, preferably takes place in at least two different spectra filtered by the use of metal foils for the location-resolved capturing of the X-radiation, which has traversed the bulk material particles integrated in at least one line sensor over a predetermined energy range.

This can take place when using a sensor means (a long line formed from numerous individual detectors) by passing through different filters and successive capturing of the transmitted radiation or, preferably, by two sensor lines with, in each case, a different filter, the filters permitting the passage of different spectra, which on the one hand tend to have a soft (low energy) and on the other a hard (high energy) character.

Preferably, a Z-classification and standardization of image areas takes place for determining the atomic density class on the basis of the sensor signals of the X-ray photons of different energy spectra captured in the at least two sensor lines.

Z-transformation produces from the intensities of two channels of different spectral imaging n classes of average atomic density (abbreviated to Z), whose association is largely independent of the X-ray transmission and, therefore, the material thickness.

The standardization of the values to an average atomic density of one or more selected representative materials makes it possible to differently classify image areas on either side of the standard curve. A calibration, in which over the captured spectrum the context is produced in non-linear manner, enables the "fading out" of equipment effects.

The atomic density class generated during the standardization to a specific Z (atomic number of an element or, more generally, average atomic density of the material) forms the typical density of the participating materials. In parallel to this, a further channel is calculated providing the resulting average transmission over the entire spectrum.

By computer-assisted combination of the atomic density class with a transmission interval ($T_{min}$, $T_{max}$) to the pixels, can be allocated a characteristic class which can be used for material differentiation.

Advantageously, a segmentation of the characteristic class formation is carried out for controlling the blow-out nozzles on the basis of both the detected average transmission of the bulk material particles in the different X-ray energy spectra captured by the at least two sensor lines, and also the density information obtained by Z-standardization.

The calcium carbonate-containing rocks according to the present invention are selected from the group comprising rocks of sedimentary and metamorphic origin, such as limestone, chalk, and marble.

Usually calcium carbonate rocks comprise varying amounts of impurities, e.g. other mineral components such as dolomite and silica containing rocks or minerals such as silica in the form of flint or quartz, feldspars, amphibolites, mica schists, and pegmatite, as disseminations, nodules, layers within the calcium carbonate rock, or as side rocks, which can be separated from the calcium carbonate in an efficient and selective manner according to the invention.

For example, flint may be separated from chalk, dolomite from calcite, or pegmatite from calcite.

However, the present invention also relates to mixed carbonate containing rocks such as dolomite rocks, from which silica containing minerals are separated.

Before the sorting and separating is carried out, the rocks are comminuted in any device suitable therefor, e.g. in a jaw, cone, or roller crusher, and optionally classified, e.g. on screens, in order to obtain a particle size of 1 to 250 mm.

Preferably, the calcium carbonate-containing rocks are comminuted to a particle size in the range of from 5 mm to 120 mm, preferably of from 10 to 100 mm, more preferably of from 20 to 80 mm, especially of from 35 to 70, e.g. of from 40 to 60 mm.

It may be further advantageous to provide one or several different particle size fractions, which are fed individually to the X-ray sorting device described above and sorted according to their X-ray transmission properties.

Typical ratios of minimum/maximum particle size within a fraction are e.g. 1:4, preferably 1:3, more preferably 1:2, or even lower, e.g. the particle sizes within a fraction may be 10-30 mm, 30-70 mm, or 60-120 mm.

The lower the ratio, the better the adjustment of the delay time between detection and ejection, the impulse of compressed air to successfully deflect the detected impurities from its initial trajectory, as well as the defined categories of mean atomic density to the sorted particle size range.

Thus, by the method according to the invention undesired mineral impurities can be separated and removed from calcium carbonate in calcium carbonate containing rocks. For example, 20-100 wt % of the contained undesired rocks can be removed, more typically 30-95 wt % or 40-90 wt %, e.g. 50 to 75 or 60 to 70 wt %.

After sorting as mentioned above, the purified calcium carbonate, e.g. chalk, limestone or marble, is preferably subjected to a dry or wet comminution step. For this purpose the particles may be fed into a wet or dry crushing or grinding stage, e.g. cone crusher, impact crusher, hammer mill, roller mill, tumbling mills as autogenous mills, ball mills, or rod mills.

After comminution, a further classification step (e.g. on a screen, in an air classifier, hydrocyclone, centrifuge) may be used for producing the final product.

The particles separated from the pure calcium carbonate particles are typically backfilled on the mine site or sold as by-product.

The figures described below and the examples and experiments serve to illustrate the present invention and should not restrict it in any way.

DESCRIPTION OF THE FIGURES

(FIG. 1*a*: sorted product, FIG. 1*b*: reject) according to experiment 1.

(FIG. 2*a*: sorted product, FIG. 2*b*: reject) according to experiment 1.

EXAMPLES

Example 1

Separation of Flint from Chalk

Figure 1A:
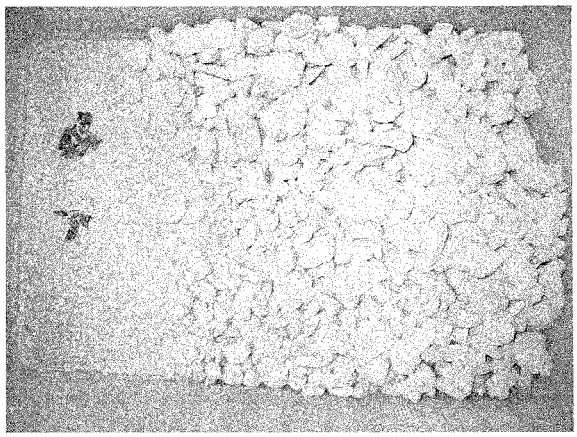
FIGS. 1*a* and 1*b* show the result of the X-ray sorting tests with 10-35 mm fraction of chalk raw material

Chalk raw material containing about 0.5-3 wt-% clay, and a high flint content of about 3-9 wt-% was pre-crushed in a jaw crusher and screened at 10 and 60 mm.

The resulting particles were split into a 10 to 35 mm fraction and a 35 to 60 mm fraction at a mass ratio of about 2:1 and fed into a Mogensen MikroSort® AQ1101 X-ray sorter. The two fractions were sorted individually by feeding half of the machine widths with one size fraction at a time utilizing the half widths of the sorter. The feed material was conveyed to the scanning area in a single homogenous layer created by an electromagnetic vibratory feeder and an inclined chute. The rocks falling from the inclined chute were scanned and ejected in free fall. The particles are accelerated and therefore isolated before they enter the free fall. Right below the chute the particles are irradiated by a pointed X-ray source with an opening angle of approximately 60°. On the opposite of the X-ray source is the double channel X-ray sensor which measures two different X-ray outputs. The evaluation of the picture data and the classification of the individual pieces of material are conducted by a high performance industrial computer within a few milliseconds. The actual rejection of the material is done approximately 150 mm below the place of detection by a solenoid valve unit which emits compressed air impulses to guide the unwanted particles over a separation plate into a material hopper. Finally, the reject and the accept material streams can be conveyed separately. The ejector assembly consisted of 218 air nozzles (3 mm diameter) which were operated with a pressure of 7 bar.

The sorting tests were carried out at a nominal throughput of 11.5 tph for the 10 to 35 mm fraction and 25 tph for the 35 to 60 mm size fraction.

In order to determine the sorting efficiency, the percentage of product in the reject (white rocks) and the amount of coloured rocks in the sorted product were determined for each sorting test by hand sorting of the product and reject stream. From these figures the recovery of coloured rocks, the sorting selectivity and the loss of white rocks were calculated (Table 1).

TABLE 1

| | Feed Material | | Product (chalk) | | Reject (flint) | | Performance Data | | |
|---|---|---|---|---|---|---|---|---|---|
| Test No | Particle Size [mm] | Flint in feed [wt-%] | Mass recovery product [wt-%] | Flint in product [wt-%] | Mass recovery reject [wt-%] | Chalk in reject [wt-%] | Flint in reject [wt-%] SELEC-TIVITY | Recovery of flint [wt-%] RECOVERY | Loss of chalk [wt-%] CALCITE LOSS |
| 1 | 10-35 | 3.30 | 93.35 | 0.20 | 6.65 | 53.57 | 46.4 | 94.4 | 3.7 |
| 2 | 35-60 | 8.46 | 91.12 | 0.40 | 8.88 | 8.91 | 91.1 | 95.7 | 0.9 |

The sorting tests clearly show that dual energy X-ray transmission sorting is an efficient technology for detection and sorting of flint from chalk raw material.

For both particle size fractions the recovery of flint was in the range of 95 wt-%. In the 10 to 35 mm size fraction the amount of flint was reduced from 3.3 wt-% in the sorter feed to 0.2 wt-% in the sorted product. In the 35 to 60 mm size fraction the amount of flint was reduced from 8.5 wt-% to 0.4 wt-% in the sorted product. In both size fractions the loss of chalk in the reject is in the range of 1-4 wt-%.

Figure 1B:
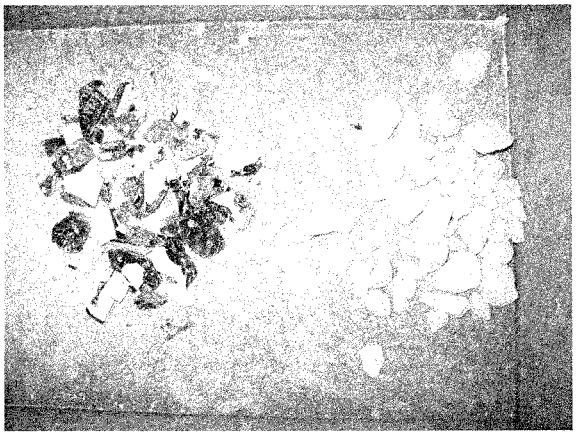
Figure 2A:
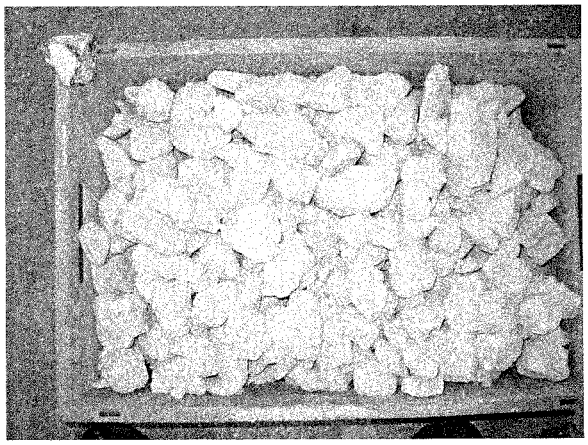
FIGS. 2*a* and 2*b* show the result of the X-ray sorting tests with 10-35 mm fraction of chalk raw material
Figure 2B:
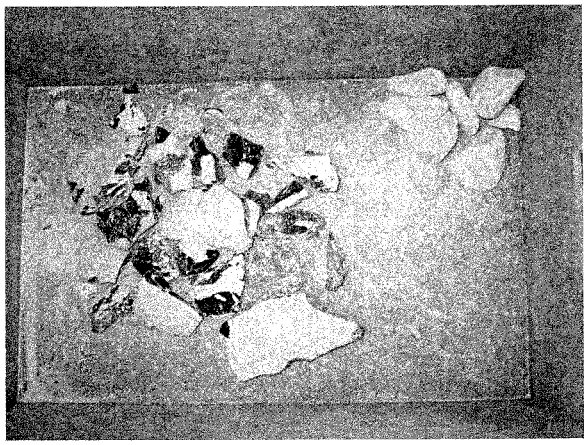

FIGS. 1*a* and 1*b* and 2 *a* and 2*b*, respectively show the results of the X-ray sorting tests with the 10-35 mm fraction (FIG. 1*a/b*) and the 35-60 mm fraction (FIG. 2*a*/b) of chalk raw material (1*a*/2*a*: sorted product; 1*b*/2*b*: reject).

Separation of the flint in the chalk raw material prior to the slaking or grinding processes is the most efficient and economical method to reduce problems with high machine wear. The X-ray sorting process can be operated directly with the pre-crushed chalk and does not need a raw material washing installation. The rejects from the sorter can be backfilled to the quarry without problems.

Example 2

Separation of Flint from Chalk

Chalk samples from four different production levels containing about 0.5-3 wt-% clay and having different flint contents of 0.4-4 wt-% (cf. table 3) were pre-crushed in a jaw crusher to a nominal particle size of 10 to 75 mm subsequently screened into 4 fractions (Table 2):

TABLE 2

| Size Fraction [mm] | Proportion [wt-%] |
|---|---|
| >63 | 31 |
| 35-63 | 40 |
| 12-35 | 21 |
| <12 | 8 |

The 12 to 35 mm fraction and the 35 to 63 mm fractions were fed into a Mogensen MikroSort® AQ1101 X-ray sorter. The two fractions were sorted individually by feeding half of the machine widths with one size fraction at a time utilizing the half widths of the sorter. The feed material was conveyed to the scanning area in a single homogenous layer created by an electromagnetic vibratory feeder and an inclined chute. The rocks falling from the inclined chute were scanned and ejected in free fall. The particles are accelerated and therefore isolated before they enter the free fall. Right below the chute the particles are irradiated by a pointed X-ray source with an opening angle of approximately 60°. On the opposite of the X-ray source is the double channel X-ray sensor which measures two different X-ray outputs. The evaluation of the picture data and the classification of the individual pieces of material are conducted by a high performance industrial computer within a few milliseconds. The actual rejection of the material is done approximately 150 mm below the place of detection by a solenoid valve unit which emits compressed air impulses to guide the unwanted particles over a separation plate into a material hopper. Finally, the reject and the accept material streams can be conveyed separately. The ejector assembly consisted of 218 air nozzles (3 mm diameter) which were operated with a pressure of 7 bar.

The sorting tests were carried out at a nominal throughput of 11.5 tph for the 12 to 35 mm fraction and 20 tph for the 35 to 63 mm size fraction.

In order to determine the sorting efficiency, the percentage of product in the reject (chalk) and the amount of flint in the sorted product were determined for each sorting test by hand sorting of the product and reject stream. From these figures the recovery of flint, the sorting selectivity and the loss of chalk were calculated (Table 3).

TABLE 3

| | Feed Material | | Product (chalk) | | Reject (flint) | | Performance Data | | |
|---|---|---|---|---|---|---|---|---|---|
| Test No | Particle Size [mm] | Flint in feed [wt-%] | Mass recovery product [wt-%] | Flint in product [wt-%] | Mass recovery reject [wt-%] | Chalk in reject [wt-%] | Flint in reject [wt-%] SELEC-TIVITY | Recovery of flint [wt-%] RECOVERY | Loss of chalk [wt-%] CALCITE LOSS |
| 1 | Chalk Level 2 12-35 | 3.91 | 94.64 | 0.85 | 5.36 | 42.06 | 57.9 | 79.4 | 2.3 |

TABLE 3-continued

| | Feed Material | | Product (chalk) | | Reject (flint) | | Performance Data | | |
|---|---|---|---|---|---|---|---|---|---|
| Test No | Particle Size [mm] | Flint in feed [wt-%] | Mass recovery product [wt-%] | Flint in product [wt-%] | Mass recovery reject [wt-%] | Chalk in reject [wt-%] | Flint in reject [wt-%] SELECTIVITY | Recovery of flint [wt-%] RECOVERY | Loss of chalk [wt-%] CALCITE LOSS |
| 2 | Chalk Level 3 12-35 | 2.76 | 95.81 | 0.58 | 4.19 | 47.35 | 52.6 | 79.9 | 2.0 |
| 3 | Chalk Level 4 12-35 | 1.21 | 97.25 | 0.20 | 2.75 | 63.17 | 36.8 | 84.0 | 1.8 |
| 4 | Chalk Level 5 12-35 | 1.27 | 96.45 | 0.00 | 3.55 | 64.10 | 35.9 | 100.0 | 2.3 |
| 5 | Chalk Level 2 35-63 | 2.98 | 96.15 | 0.54 | 3.85 | 35.94 | 64.1 | 82.7 | 1.4 |
| 6 | Chalk Level 3 35-63 | 0.45 | 96.94 | 0.09 | 3.06 | 88.15 | 11.9 | 80.9 | 2.7 |
| 7 | Chalk Level 4 35-63 | 1.35 | 96.00 | 0.12 | 4.00 | 69.22 | 30.8 | 91.4 | 2.8 |
| 8 | Chalk Level 5 35-63 | 1.81 | 95.72 | 0.03 | 4.28 | 58.41 | 41.6 | 98.2 | 2.5 |

The sorting tests clearly showed that dual energy X-ray transmission sorting is an efficient technology for detection and sorting of flint from chalk raw material.

For both particle size fractions and all tested samples a flint recovery in the range of 80-90 wt-% was achieved.

The flint content detected in the feed material from the various production levels varied between 0.5 wt-% and 3.9 wt-%. By X-ray sorting the flint content could be reduced to 0.1 to 0.8 wt-% in the sorted product of both size fractions.

The reject stream for both size fractions contained about 50 wt-% chalk and 50 wt-% flint, which results in a loss of chalk in the reject in the range of 1.5 to 4 wt-%.

Figure 3A:
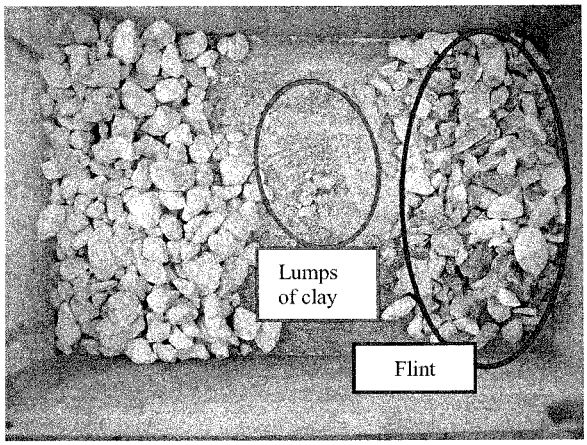
FIGS. 3*a* and 3*b* show the rejects from the X-ray sorting tests with chalk from level 2 (FIG. 3*a*) and level 3 (FIG. 3*b*) (35 to 63 mm fraction) according to experiment 2.
Figure 3B:
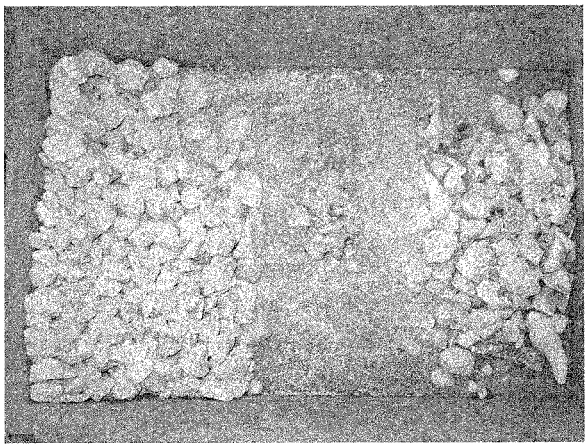
Figure 4A:
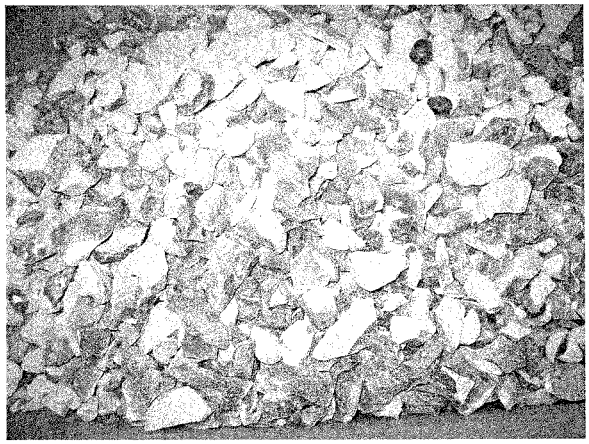
FIGS. 4 *a* and 4*b* show the rejects from the X-ray sorting tests with chalk from level 4 (FIG. 4*a*) and level 5 (FIG. 4*b*) (35 to 63 mm fraction) according to experiment 2.
Figure 4B:
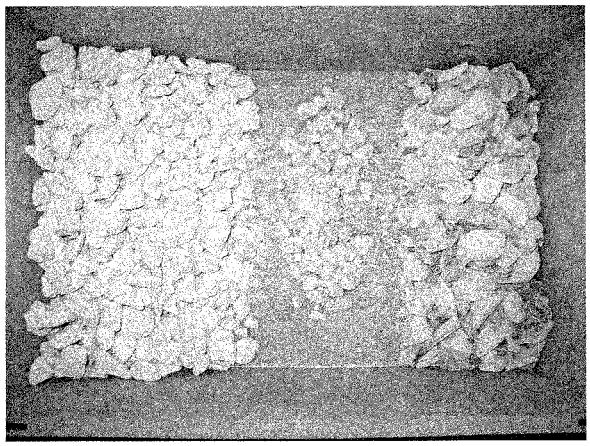

This is also clearly shown in FIGS. 3*a* and 3*b*, and 4 *a* and 4*b*, respectively showing the rejects from the X-ray sorting tests with chalk from level 2 (FIG. 3*a*) (35 to 63 mm fraction) and level 3 (FIG. 3*b*) (35 to 63 mm fraction) as well as from level 4 (FIG. 4*a*) (35 to 63 mm fraction) and 5 (FIG. 4*b*) (35 to 63 mm fraction).

Furthermore, by hand sorting and evaluation of the rejects from the sorting tests it became apparent that the X-ray sorter even detected and rejected lumps of clay (cf. FIG. 3*b*).

Example 3

Separation of Dolomite and Pegmatite from Calcite

Figure 5A:
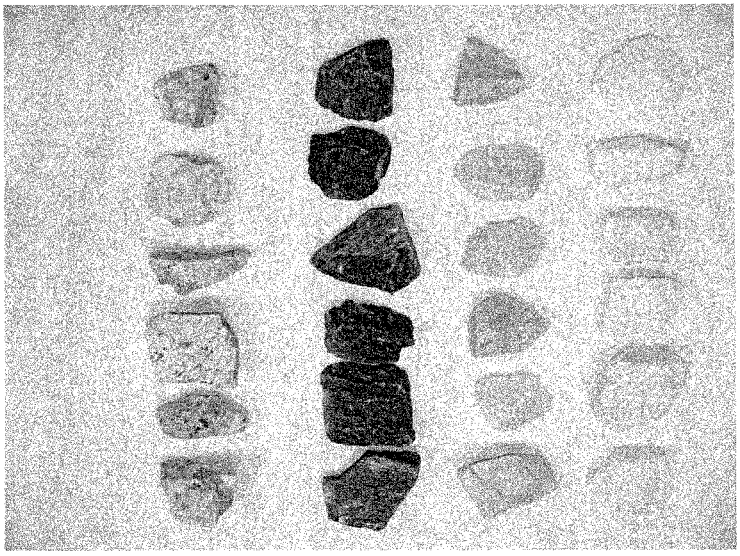
FIG. 5*a* shows the mineral constituents present in the feed: pegmatite, amphibolite, dolomite and calcite (from left to right)

A calcium carbonate raw material sample containing 60-80 wt-% calcite, 10-20 wt-% dolomite, 5-10 wt-% pegmatite and 5-10 wt-% amphibolite (cf. FIG. 5 a showing the mineral constituents present in the feed: pegmatite, amphibolite, dolomite and calcite (from left to right)), was pre-crushed and screened into different size fractions. The size fraction of 11-60 mm was fed into a Mikrosort AQ1101 X-ray sorter with the major aim of removing dolomite and pegmatite from the calcium carbonate.

Figure 5B:
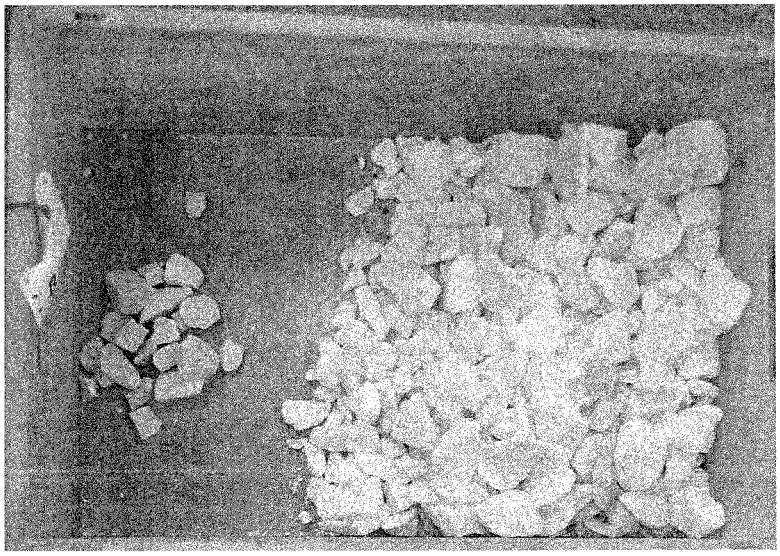
FIG. 5*b* shows the accept after X-ray sorting.
Figure 5C:
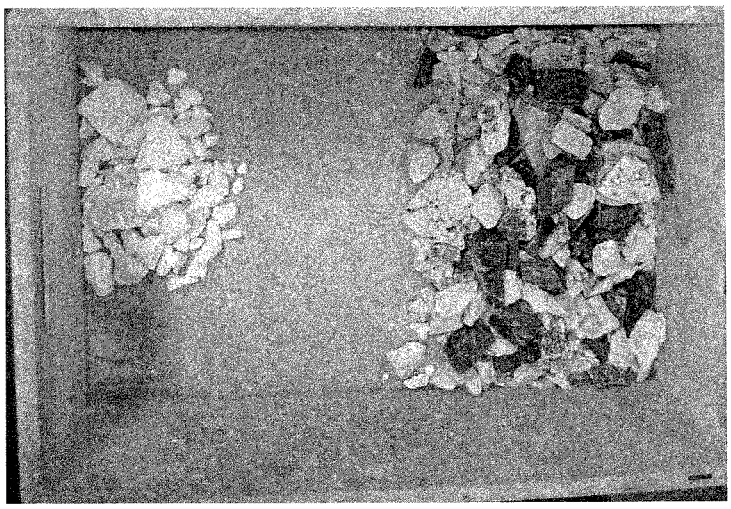
FIG. 5*c* shows the reject after X-ray sorting according to experiment 3.

The results, as well as FIG. 5*b* showing the accept and FIG. 5*c* showing the reject after X-ray sorting, respectively, clearly demonstrate that the majority of the impurities (dolomite, pegmatite) could be detected and successfully separated by X-ray sorting. As depicted in table 4, 82 wt % of the dolomite and >99 wt % of the pegmatite particles were removed, recovering 67 wt % of mass in the accept and losing solely 7.7 wt % of carbonate into the reject.

TABLE 4

| Feed Material | | | | Product = Accept | | | Reject | | Performance data | | | |
|---|---|---|---|---|---|---|---|---|---|---|---|---|
| | | | | | | | | | | Recovery in reject [wt-%] | | |
| Particle size [mm] | Dolomite [wt-%] | Pegmatite [wt-%] | Amphibolite [wt-%] | Mass [wt-%] | Dolomite [wt. %] | Pegmatite [wt. %] | Mass [wt-%] | Calcite [wt-%] | Selectivity [wt-%] | Dolomite [wt-%] | Pegmatite [wt. %] | Calcite loss [wt. %] |
| 11-60 | 14 | 7 | 7 | 67.2 | 3.7 | 0.05 | 32.8 | 16.8 | 83.2 | 82.2 | 99.5 | 7.7 |

The invention claimed is:

1. A method for separating mineral impurities from calcium carbonate-containing rocks comprising the steps of:

(a) comminuting and classifying calcium carbonate-containing rocks to obtain calcium carbonate particles having a particle size in the range of from 1 mm to 250 mm; and (b) introducing the calcium carbonate particles into an x-ray sorting device to remove mineral impurities from the calcium carbonate particles; wherein the x-ray sorting device comprises a means for transporting the calcium carbonate particles through the device, an x-ray source that emits radiation through at least two filter devices at different energy spectra to a flow of the calcium carbonate particles; at least one sensor means that measures two different x-ray outputs from the flow of the calcium carbonate particles at a detection area, a computer-controlled evaluating means that evaluates sensor signals resulting from the x-ray outputs at the detection area; and a separation means downstream of the detection area, that separates mineral impurities from the calcium carbonate particles.

2. The method according to claim 1, wherein the transporter means is a conveyor belt sorter or a chute gravity sorter.

3. The method according to claim 1, wherein a sensor line corresponding to a width of the particle flow is formed by the at least one sensor means that comprises linearly disposed detector means.

4. The method according to claim 3, wherein the detector means comprise photodiode arrays equipped with a scintillator for converting x-radiation into visible light.

5. The method according to claim 1, wherein the at least two filters are metal foils through which the X-radiation of mutually different energy levels is transmitted.

6. The method according to claim 1, wherein the at least two filters are positioned below the particle flow and upstream of the at least one sensor means, and an X-ray tube producing a brems spectrum is positioned above the particle flow.

7. The method according to claim 1, wherein a sensor line is provided for each of the at least two filters.

8. The method according to claim 1, wherein the at least two filters include a plurality of filters for using with a plurality of energy levels.

9. The method according to claim 1, wherein the computer-controlled evaluating means determines a Z-classification, a standardization of image areas and an atomic density class based on the sensor signals.

10. The method according to claim 1, wherein the mineral impurities are separated using the separation means based on detected average transmission in different X-ray energy spectra captured by the at least two sensor lines, and density information obtained by Z-standardization.

11. The method according to claim 1, wherein the calcium carbonate-containing rocks comprise limestone, chalk, marble, or dolomite.

12. The method according to claim 1, wherein the mineral impurities comprise dolomite, silica, flint, quartz, feldspars, an amphibolite, a mica schist, and/or pegmatite.

13. The method according to claim 1, wherein the calcium carbonate-containing rocks are comminuted in step (a) to a particle size in the range of from 5 mm to 120 mm.

14. The method according to claim 1, wherein the calcium carbonate-containing rocks are comminuted in step (a) to a particle size in the range of from 10 mm to 100 mm.

15. The method according to claim 1, wherein the calcium carbonate-containing rocks are comminuted in step (a) to a particle size in the range of from 20 mm to 80 mm.

16. The method according to claim 1, wherein the calcium carbonate-containing rocks are comminuted in step (a) to a particle size in the range of from 35 mm to 70 mm.

17. The method according to claim 1, wherein the calcium carbonate-containing rocks are comminuted in step (a) to a particle size in the range of from 40 mm to 60 mm.

18. The method according to claim 1, wherein one or several different size fractions of the comminuted particles from step (a) are each subjected to a different step (b).

19. The method according to claim 18, wherein each fraction has particles at minimum/maximum particle size ratio of 1 :4.

20. The method according to claim 18, wherein each fraction has particles at minimum/maximum particle size ratio of 1 :3.

21. The method according to claim 18, wherein each fraction has particles at minimum/maximum particle size ratio of 1 :2.

22. The method according to claim 18, wherein a fraction introduced in step (b) has a particle size in a range of from 10-30 mm.

23. The method according to claim 18, wherein a fraction introduced in step (b) has a particle size in a range of from 30-70 mm.

24. The method according to claim 18, wherein a fraction introduced in step (b) has a particle size in a range of from 60-120 mm.

25. The method according to claim 1, which further comprises introducing the calcium carbonate particles resulting from step (b) to a comminution step (c).

26. The method according to claim 24, wherein subsequent to the comminution step (c), the calcium carbonate particles are subjected to a classification step (d).

* * * * *